US005571384A

United States Patent [19]

Pikka et al.

[11] Patent Number: 5,571,384

[45] Date of Patent: Nov. 5, 1996

[54] METHOD AND ARRANGEMENT FOR THE TREATMENT OF A FIBER SUSPENSION

[75] Inventors: Olavi Pikka; Hannu Rönkönharju, both of Karhula, Finland

[73] Assignee: A. Ahlstrom Corporation, Noormarkku, Finland

[21] Appl. No.: 510,016

[22] Filed: Aug. 1, 1995

Related U.S. Application Data

[62] Division of Ser. No. 73,793, Jun. 8, 1993, Pat. No. 5,470, 432.

[30] Foreign Application Priority Data

Jun. 8, 1992 [FI] Finland ..... 922635

[51] Int. Cl.[6] ..... D21C 7/00

[52] U.S. Cl. ..... 162/242; 162/251

[58] Field of Search ..... 162/55, 60, 251, 162/237, 242, 241, 232

[56] References Cited

U.S. PATENT DOCUMENTS

| | | | |
|---|---|---|---|
| 3,830,688 | 8/1974 | Mannbro | 162/55 |
| 4,529,520 | 7/1985 | Lampenius | 210/498 |
| 4,999,085 | 3/1991 | Luntamo | 162/40 |
| 5,000,842 | 3/1991 | Luokkoi | 209/273 |

FOREIGN PATENT DOCUMENTS

| | | |
|---|---|---|
| 1102604 | 6/1991 | Canada . |
| 781789 | 6/1978 | Finland . |
| 77276 | 2/1989 | Finland . |
| 465781 | 9/1989 | Sweden . |

*Primary Examiner*—Peter Chin

*Attorney, Agent, or Firm*—Cohen, Pontani, Lieberman, Pavane

[57] ABSTRACT

An apparatus and method for screening pulp after bleaching. The apparatus includes a first bleaching tower for bleaching pulp, a screener for screening and separating the bleached pulp into a first accept fraction and a first reject fraction such that the first accept fraction is supplied to a post-screening treatment device without further treatment by a separate thickener. The apparatus further includes a vortex cleaner for separating the first reject fraction into a second accept fraction and a second reject fraction such that the second accept fraction is supplied to the screener or the post-screening treatment device without a separate thickener.

7 Claims, 2 Drawing Sheets

METHOD AND ARRANGEMENT FOR THE TREATMENT OF A FIBER SUSPENSION

This is a division of application Ser. No. 08/073,793, filed Jun. 8, 1993, now U.S. Pat. No. 5,470,432.

FIELD OF THE INVENTION

The present invention relates to a method and an arrangement for the treatment of fiber suspensions in the pulp and paper industry. In particular, the invention relates to intensifying the so-called postscreening of pulp in the bleaching stage.

BACKGROUND AND SUMMARY OF THE INVENTION

Arrangements previously used for the above mentioned purpose, e.g. as disclosed in FI Patent 77276, include devices wherein pulp in a bleaching stage is supplied either subsequent to a pressure screen or directly to a vortex cleaning plant in which the heavier impurities still in the pulp, such as shives, large fiber floes and the like, are separated therefrom. As is known, a vortex cleaning plant comprises dozens of vortex cleaners, i.e. hydrocyclones, the cleaning effect of which is based on the recirculation of the material to be cleaned along the cylindrical or conical wall of the cleaner at a high velocity. The coarse material comprising the reject fraction accumulates due to the centrifugal force on the surface of the cyclone rapidly wearing it out, thereby firstly diminishing the cleaning efficiency of the cleaner when the rotational speed of the material rapidly decreases due to additional friction eventually resulting in one or more holes in the wall of the vortex cleaner through which the material to be cleaned will escape to the floor of the screening space. Further, a vortex cleaning plant requires a rather large space mainly due to the large number of individual cyclones. The use of cyclones also has a third disadvantage, namely a significant increase in water circulation and effluent loading. To operate efficiently the consistency of the fiber suspension to be cleaned with vortex cleaners must be tenths of one per cent, so that the acceptable fibrous material may be effectively separated from knot particles and shives.

Yet another disadvantage of a vortex cleaning plant is that the consistency of the pulp flowing to the inlet box of the washers most frequently used in a bleaching plant must be approximately 1.2%, at least about 1.0%. Similarly, the drying apparatus operating as a treatment stage subsequent to bleaching requires a supply consistency of the same about 1.0–1.2%. This requires that the pulp must be thickened from about 0.5% to the consistency of about 1.0–1.2%.

The aforementioned disadvantages of the apparatus in accordance with the prior art may be eliminated by replacing the vortex cleaning plant, for example, with narrow-slot screening, whereby one single screener performs the work of tens of vortex cleaners. At the same time the thickener previously required subsequent to the vortex cleaning plant has become superfluous. Savings in the space is thus self-evident as well as the decrease in liquid loading, because the suspension to be treated does not have to be diluted to the level required by the vortex cleaning plant, rather, it may be left at the consistency level of the inlet box of a washer or a drying apparatus. Consequently, the demand on the dilution liquid is significantly diminished. It has also been suggested that the screening itself were carried out at a medium consistency with a fluidizing screener. For example, FI patent application 781789 corresponding to CA patent 1,102,604, and published SE patent application 465 781 relate to such arrangements. Said screening method has at least not at the present been accepted even for coarse screening at mill scale, so it is very unlikely that fine screening will ever be carried out at medium consistency. Thus at least for the present everything is based on the fact that pulp must be considerably diluted between the bleaching stages or thereafter prior to the screening. The characterizing features of the method and arrangement in accordance with the present invention become apparent in the enclosed claims.

BRIEF DESCRIPTION OF THE DRAWING

The invention is described in more detail below, by way of example, with reference to the accompanying drawings, in which.

DETAILED DESCRIPTION OF THE PRESENTLY PREFERRED EMBODIMENTS

Figure 1:
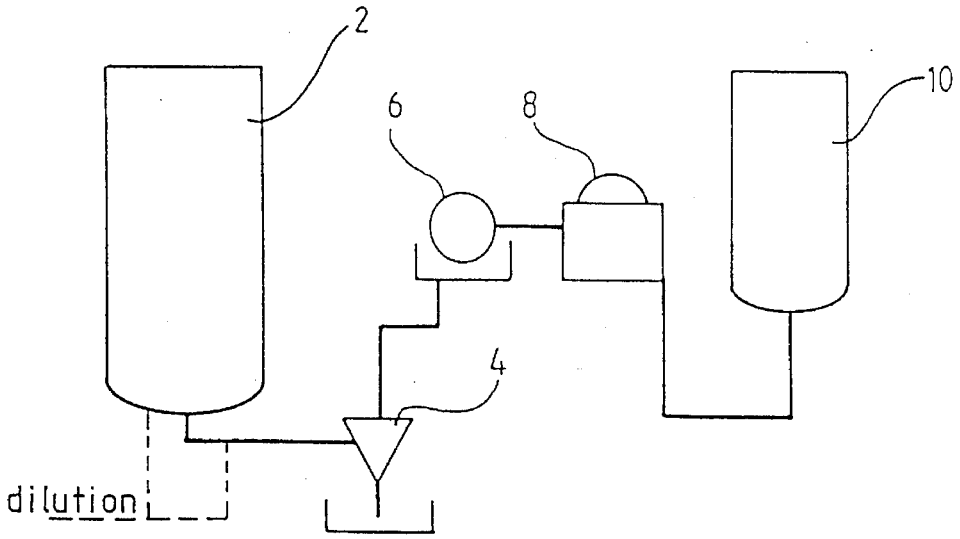
FIG. 1 (PRIOR ART)
FIG. 1 schematically illustrates an arrangement in accordance with the prior art.

According to FIG. 1 an arrangement in accordance with the prior art mainly comprises a bleaching tower 2, a vortex cleaning plant 4 subsequent to said bleaching tower, a thickener 6 and a washer, most usually a drum washer 8, and a bleaching tower 10 of the following bleaching stage. The fiber suspension to be treated is discharged from the bleaching tower 2 to a pipe line, in which pulp is diluted to a consistency of about 0.5% and from which it is further supplied to vortex cleaners 4. Subsequent to the cleaners the accepted material is supplied directly to thickener 6, the purpose of which is to thicken the pulp to the feed consistency of the washer 8. The pulp is then supplied from the thickener 6 to the washer 8, from which the washed pulp is discharged at a consistency, which corresponds to the bleaching consistency of a bleaching tower. Often a pre-thickener is necessary to raise the consistency of the accept fraction to the level of the supply consistency of the washer. The reject of the vortex cleaners is discharged from the apparatus either to be destroyed or to be supplied to an earlier treatment stage.

Figure 2:
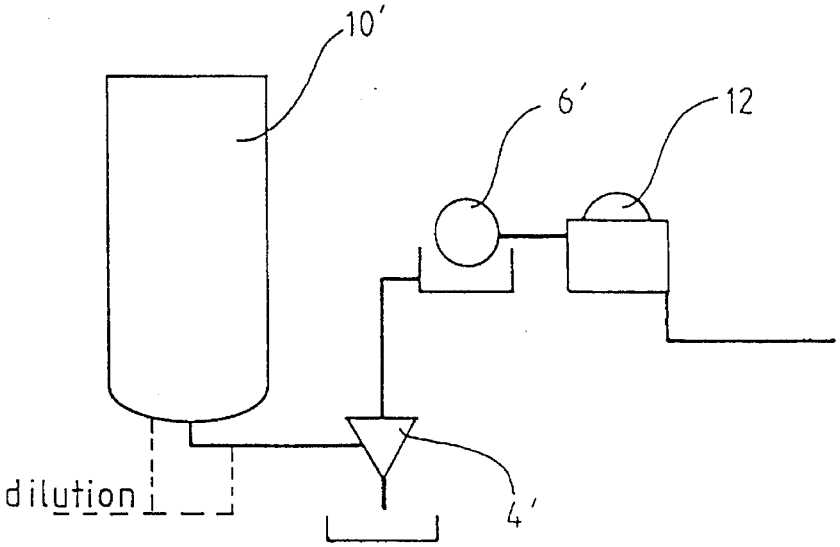
FIG. 2 (PRIOR ART)
FIG. 2 schematically illustrates a second arrangement in accordance with the prior art.

An arrangement in accordance with FIG. 2 deviates from that of FIG. 1 in that the vortex cleaning plant 4' is located after the last bleaching tower 10' so that the pulp is supplied from the vortex cleaning plant 4' to the thickener 6', wherein the consistency of the pulp is raised to the supply consistency of a subsequent drying apparatus. Thereafter the pulp is supplied to the drying apparatus 12, in which the consistency of the pulp is again raised to the level required for storage and transportation.

Figure 3:
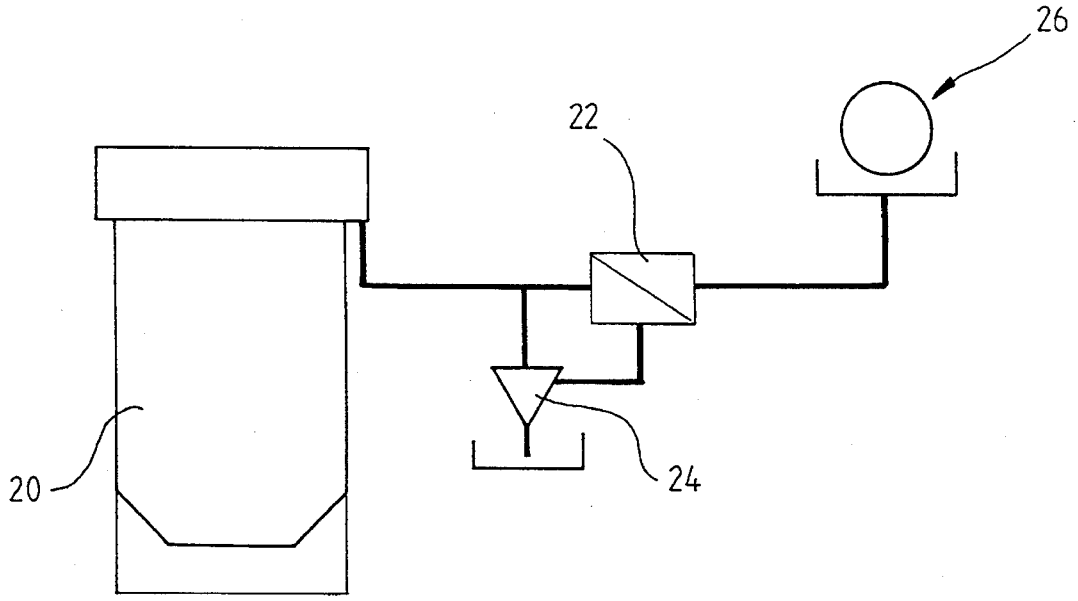
FIG. 3 schematically illustrates an arrangement in accordance with the present invention.

FIG. 3 illustrates an arrangement in accordance with an exemplary embodiment of the present invention, comprising a bleaching tower 20, a screener 22, a vortex cleaner/cleaning plant 24, a washer 26 and a bleaching tower (not shown) of the subsequent bleaching stage, most usually the last stage. According to the present invention pulp bleached in tower 20 is discharged from the bleaching tower 20 into a pipe line leading to a screener 22, either so that it is diluted as it is discharged or the pulp is diluted in the bleaching tower to the screening consistency of approximately 1.0–1.2%. The accept of the screener 22 is supplied directly to a washer 26 and the reject is diluted to a consistency which is suitable for the cyclones and supplied to a vortex cleaning plant 24, which is considerably smaller than the prior art apparatus. The accept of the vortex cleaners 24 is returned to the feed of the above mentioned screener 22 or directly to the washer 26. The reject, on the other hand, is either removed from the system or supplied again to an earlier treatment stage for the suspension.

Figure 4:
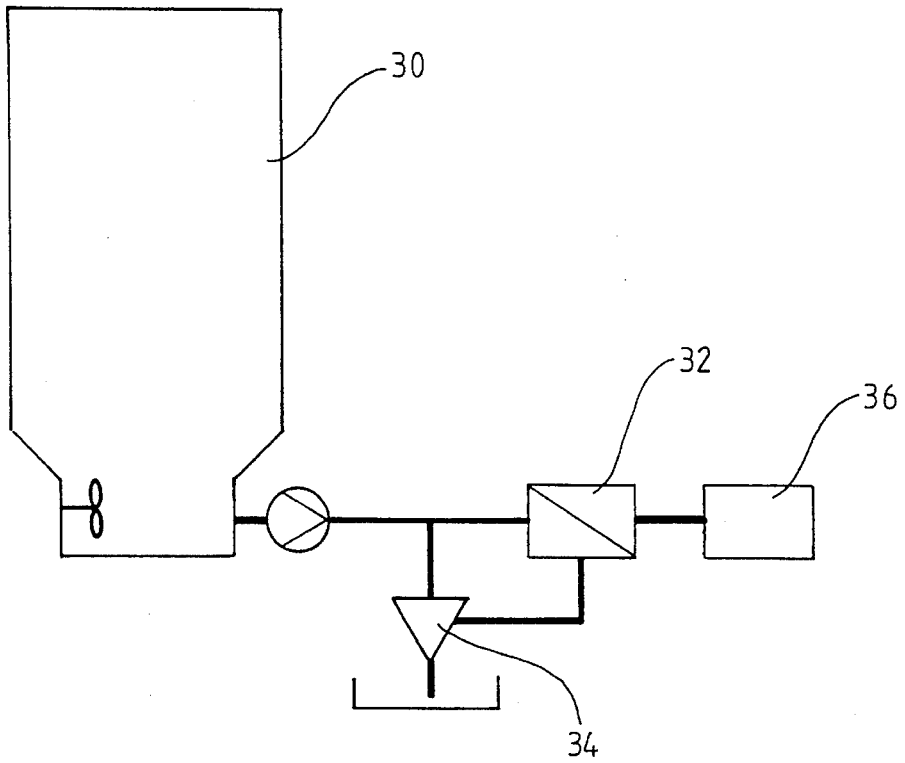
FIG. 4 schematically illustrates a second arrangement in accordance with the present invention.

FIG. 4 illustrates a method of treating pulp in accordance with a second exemplary embodiment of the present invention. Bleached pulp is supplied, for example, from the last bleaching stage, more accurately from the bleaching tower thereof, or more generally from the storage tower 30 for pulp suitably diluted, for example, by a mixer located at the bottom of the tower, to a screener 32, through which the accepted pulp is supplied directly to a drying apparatus 36.

A screen plate/cylinder in accordance with U.S. Pat. No. 4,529,520 which is hereby incorporated by reference herein is preferably used in the invention, the surface of the screen plate/drum having grooves in the surface of the screen drum facing the rotor, said grooves being perpendicular to the flow direction of the pulp. The grooves comprise according to a preferred embodiment at least a side surface approximately perpendicular to the envelope surface of the plate on the upstream side of the groove and an inclined side surface on the downstream side. Moreover, the grooves may also comprise a bottom surface substantially parallel to the envelope surface. The screen slots or holes are located on the surface of the grooves either in the close proximity of the bottom of the perpendicular side surface or slightly further therefrom. The exemplary embodiment in accordance with the invention preferably uses narrow slots, the width of which is of the range of less than 0.25 mm. A preferred method of manufacture for said slots is water jet cutting, whereby the direction of the slot is optimized so that the flow resistance caused by the slot is at its minimum. Of course, other screen cylinder types may also be considered ranging from completely smooth, i.e. grooveless drums to cylinders otherwise grooved or provided with other kinds of unevenness. Also the shape of the screen element itself may be cylindrical, conical, biconical or even planar. The rotor of said pressure screen may be, for example, a rotor in accordance with U.S. Pat. No. 5,000,842, which is hereby incorporated by reference herein and in which the surface of the rotor cylinder is provided with so called bulges to generate turbulence breaking fiber flocs in the pulp. Also so-called foil rotors may in some cases be utilized. It is also possible to use a screen cylinder both outside or inside the rotor or even screen cylinders located on both sides of the rotor. Further in some cases the use of one or more rotatable screen cylinders may be considered.

If the screening method in accordance with the present invention is compared with the screening carried out by a vortex separator according to the prior art (screening consistency 0.5%) with respect to the liquid used for dilution, it is evident that the amount of liquid used for the dilution of the pulp to be screened is only about 40% in the method in accordance with the present invention when compared with the method in accordance with the prior art.

| | Fibers in pulp | Liquid in pulp prior to dilution | Dilution Liquid in pulp |
|---|---|---|---|
| Prior art orig. cons. 10% final cons. 0.5% | 1 kg | 9 kg | 190 kg |
| Invention, orig. cons. 10% final cons. 1.2% | 1 kg | 9 kg | 73 kg |
| Prior art orig. cons. 15% final cons. 0.5% | 1 kg | 5.7 kg | 193.3 kg |
| Invention orig. cons. 15% final cons. 1.2% | 1 kg | 5.7 kg | 76.6 kg |

As the above example illustrates the method in accordance with the present invention considerably improves, i.e. decreases, the liquid consumption of the pulp mill and thus also the consumption of energy utilized for the pumping process. It is evident that by changing from the prior art vortex cleaners or hydrocyclones, i.e. from a consistency of below 0.5%, to narrow-slot screening which is performed at a consistency of approximately 1.0–1.2%, considerably higher absolute savings are achieved with respect to the consumption of the dilution liquid than would possibly be expected by further development of the screening technique, such as screening performed at a higher consistency, e.g. at medium consistency. Thus, if the amount of liquid saved with the present invention for one kg fiber is approximately 120 kg, the savings achieved with medium consistency screening would only be approximately 70 kg, despite the fact that no dilution would be necessary and the consistency would remain the same.

It should also be understood that the preferred embodiments and examples described are for illustrative purposes only and are not to be construed as limiting the scope of the present invention which is properly delineated only in the appended claims.

What is claimed is:

1. An apparatus for treating pulp, comprising:

a first bleaching tower for bleaching pulp;

a post-screening treatment device including at least one of a washer, a thickener, a dryer and a second bleaching tower;

a screener in fluid communication with said first bleaching tower and said post-screening treatment device, said screener including a pressure screen for generating from the pulp exiting said bleaching tower a first reject fraction and a first accept fraction, such that said first accept fraction is supplied to one of said post-screening treatment devices without further treatment by a separate thickener; and a vortex cleaner including means for generating from said first reject fraction a second reject fraction and a second accept fraction, said vortex cleaner being connected with one of said screener and said post-screening treatment device such that said second accept fraction is supplied to one of said screener and said post-screening treatment device without further treatment by a separate thickener.

2. The apparatus of claim 1, wherein said post-screening treatment device is a washer and said pressure screen is disposed downstream said first bleaching tower and upstream said washer.

3. The apparatus of claim 1, wherein said post-screening treatment device is a dryer and said pressure screen is disposed downstream said first bleaching tower and upstream said dryer.

4. The apparatus of claim 1, wherein said pressure screen comprises a rotatable rotor and a screen drum surrounding said rotor.

5. The apparatus of claim 4, wherein a surface of said screen drum facing said rotor defines a plurality of grooves, said grooves being perpendicular to a flow direction of the pulp.

6. The apparatus of claim 5, wherein each of said plurality of grooves has a bottom surface defining a narrow slot extending through said screen drum.

7. The apparatus of claim 6, wherein each of said plurality of narrow slots has a width that is less than 0.25 mm.

* * * * *